US009347019B2

(12) United States Patent
Shaw et al.

(10) Patent No.: US 9,347,019 B2
(45) **Date of Patent: *May 24, 2016**

(54) LUBRICATING OIL COMPOSITION

(75) Inventors: Robert W. Shaw, Abingdon (GB); James L. Head, Oxford (GB); Marco Corradi, Oxford (GB); Shamsedin Rostami, Oxford (GB)

(73) Assignee: INFINEUM INTERNATIONAL LIMITED (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/304,873

(22) Filed: Nov. 28, 2011

(65) Prior Publication Data

US 2012/0135901 A1 May 31, 2012

(30) Foreign Application Priority Data

Nov. 30, 2010 (EP) ..... 10193046

(51) Int. Cl.

| | |
|---|---|
| ***C10M 159/22*** | (2006.01) |
| ***C07C 51/15*** | (2006.01) |
| ***C10M 129/54*** | (2006.01) |
| ***B01D 19/04*** | (2006.01) |
| ***C10M 133/06*** | (2006.01) |
| ***C10M 169/04*** | (2006.01) |

(52) U.S. Cl.

CPC ..... *C10M 169/04* (2013.01); *C10M 2207/262* (2013.01); *C10M 2215/064* (2013.01); *C10M 2223/045* (2013.01); *C10N 2230/08* (2013.01); *C10N 2230/10* (2013.01); *C10N 2230/42* (2013.01); *C10N 2230/43* (2013.01); *C10N 2230/45* (2013.01); *C10N 2240/10* (2013.01)

(58) Field of Classification Search

CPC ..... C01N 2210/02; C10M 159/22; C10M 2207/144; C10M 2215/04

USPC ..... 508/460, 518, 545

See application file for complete search history.

(56) References Cited

U.S. PATENT DOCUMENTS

| | | | | |
|---|---|---|---|---|
| 2002/0058593 | A1 | 5/2002 | Bovington et al. | |
| 2003/0134756 | A1 | 7/2003 | Carrick et al. | |
| 2008/0020955 | A1 * | 1/2008 | Diggs et al. | 508/391 |

FOREIGN PATENT DOCUMENTS

| | | | |
|---|---|---|---|
| EP | 1167497 | A2 | 1/2002 |
| EP | 1788068 | A1 | 5/2007 |
| EP | 1947164 | A1 | 7/2008 |

* cited by examiner

*Primary Examiner* — Vishal Vasisth

(57) ABSTRACT

A low sulphated ash lubricating oil composition comprises an ashless aromatic amine antioxidant and an overbased magnesium detergent which exhibits improved thermal oxidation stability.

11 Claims, No Drawings

LUBRICATING OIL COMPOSITION

FIELD OF THE INVENTION

The present invention relates to automotive lubricating oil compositions having low levels of sulphated ash and desirable thermal oxidative stability characteristics, more especially to such automotive lubricating oil compositions for use in gasoline (spark-ignited) and diesel (compression-ignited) internal combustion engines, crankcase lubrication, such compositions being referred to as crankcase lubricants; and to the use of additives in such compositions for improving the thermal oxidative stability of the lubricating oil composition and controlling/inhibiting an increase in viscosity of the lubricating oil composition due to the thermal oxidation of the lubricating oil composition.

In particular, although not exclusively, the present invention relates to automotive lubricating oil compositions having low levels of sulphated ash, and preferably low levels of phosphorus and also low levels of sulfur, which, in use, exhibit improved thermal oxidative stability and reduced levels of oil thickening due to thermal oxidation of the lubricant, thereby increasing the longevity of the lubricating oil composition and extending the service life of exhaust gas after-treatment devices, without the need for including relatively large amounts of expensive ashless antioxidants in the lubricating oil composition.

BACKGROUND OF THE INVENTION

A crankcase lubricant is an oil used for general lubrication in an internal combustion engine where an oil sump is situated generally below the crankshaft of the engine and to which circulated oil returns. It is well known to include additives in crankcase lubricants for several purposes.

Environmental concerns have led to continued efforts to reduce the CO, hydrocarbon and nitrogen oxide ($NO_x$) emissions of compression ignited (diesel-fuelled) and spark ignited (gasoline-fuelled) light duty internal combustion engines. Further, there have been continued efforts to reduce the particulate emissions of compression ignited light duty internal combustion engines. To meet the upcoming emission standards for passenger cars, original equipment manufacturers (OEMs) will rely on the use of additional exhaust gas after-treatment devices. Such exhaust gas after-treatment devices may include catalytic converters, which can contain one or more oxidation catalysts, $NO_x$ storage catalysts, and/or $NH_3$ reduction catalysts; and/or a particulate trap.

Oxidation catalysts can become poisoned and rendered less effective by exposure to certain elements/compounds present in engine exhaust gasses, particularly by exposure to phosphorus and phosphorus compounds introduced into the exhaust gases by the degradation of phosphorus-containing lubricating oil additives. Reduction catalysts are sensitive to sulfur and sulfur compounds in the engine exhaust gases introduced by the degradation of both the base oil used to blend the lubricant, and sulfur-containing lubricating oil additives. Particulate traps can become blocked by metallic ash, which is a product of degraded metal-containing lubricating oil additives.

To insure a long service life, lubricating oil additives that exert a minimum negative impact on such after-treatment devices must be identified, and OEM specifications for "new service fill" and "first fill" lubricants typically require maximum sulfur levels of 0.30 mass %, maximum phosphorus levels of 0.08 mass %, and sulfated ash contents below 0.80 mass %; such lubricating oil compositions can be referred to as "low SAPS" (low sulfated ash, phosphorus, sulfur) lubricating oil compositions. In this respect, the European Automobile Manufacturers' Association (ACEA) C1-08 and C4-08 specifications impose even more stringent requirements and, for example, stipulate a sulphated ash content of less than or equal to 0.5 mass %; similarly, the Renault RN0720 specification stipulates a sulphated ash content of less than or equal to 0.50 mass %.

At the same time as complying with such low SAPS requirements, the lubricating oil composition, in use, must also provide adequate lubricant performance, including a permissible and defined level of thermal oxidative stability and viscosity increase due to thermal oxidation of the lubricant, in accordance with the particular specification. However, it has been found that reducing the amount of metal containing lubricant additives, for example metal containing detergents and metal containing anti-wear agents (e.g. ZDDP), in the lubricant typically has a negative impact on the thermal oxidative stability of the lubricant. Hence, low SAPS lubricating oil compositions, especially those having reduced sulphated ash levels, in use, tend to be more prone to thermal oxidation and may exhibit an unacceptably large increase in viscosity due to thermal oxidation of the lubricant. Although, it may be possible to improve the oxidative stability of such lubricants and counteract the thermally induced oxidative viscosity increase by including larger amounts of ashless (i.e. non-metal containing) antioxidants in the lubricating oil composition, such anti-oxidants are relatively expensive. There is therefore a need for a low sulphated ash, particularly low SAPS, lubricating oil composition which, in use, exhibits improved thermal oxidative stability and reduced levels of oil thickening due to thermal oxidation of the lubricant, without the need for the use of substantial amounts of relatively expensive ashless antioxidants.

SUMMARY OF THE INVENTION

The present invention is based on the discovery that the thermal oxidative stability of a low sulphated ash, particularly a low SAPS, lubricating oil composition may be improved, for example to pass OEM's defined specifications such as the Catalyst Oxidation Test (TOC-3) Procedure D55 3099 by Renault which is required to meet the Renault RN0720 specification, without the need to include relatively large amounts of expensive ashless anti-oxidants if the lubricant includes a defined relatively low minimum amount of an ashless aromatic amine antioxidant in combination with a specific detergent component having a defined minimum magnesium concentration which includes an overbased magnesium detergent so as to provide the lubricant with at least a minimum defined level of magnesium. Although only theory, there appears to be a positive interaction between the ashless aromatic amine antioxidant component and the specific detergent component including the overbased magnesium detergent which provides a positive credit in terms of thermal oxidation stability. In particular, for a lubricant having a low sulphated ash level it is possible to improve the thermal oxidative stability of the lubricant, whilst maintaining the sulphated ash level constant, either by increasing the amount of ashless aromatic amine antioxidant in the lubricant or by increasing the concentration of magnesium in the detergent component (i.e. increasing the amount of overbased magnesium detergent in the detergent component relative to the amount of other metal detergents which may be present in the detergent component whilst maintaining a constant sulphated ash level), and hence increasing the amount of magnesium in the lubricant composition, or a combination of both. Hence, it is possible to formulate a low sulphated ash, particularly low SAPS, lubricating oil composition which can pass stringent OEM oxidation requirements (e.g. Catalyst Oxidation Test (TOC-3) Procedure D55 3099 by Renault), and thereby exhibit reduced levels of viscosity increase due to thermal oxidation, without the use of relatively large amounts of ashless antioxidants by carefully balancing the concentration of magnesium in the detergent component with the amount of ashless aromatic amine antioxidant in the lubricating oil composition for a particular sulphated ash content.

Thus, in accordance with a first aspect, the present invention provides a lubricating oil composition having a sulphated ash content of less than 0.6 mass % as determined by ASTM D874, the composition comprising:

(A) an oil of lubricating viscosity in a major amount;

(B) an antioxidant component, as an additive in an effective minor amount, comprising an oil-soluble or oil-dispersible ashless aromatic amine antioxidant present in an amount of at least 0.75 mass %, based on the total mass of the lubricating oil composition; and, (C) a detergent component, as an additive in an effective minor amount, comprising an oil-soluble or oil-dispersible overbased magnesium detergent providing the lubricating oil composition with at least 0.05 mass % of magnesium, based on the total mass of the lubricating oil composition, wherein greater than 45 mass % of the metal content of the detergent component (C), based on the total mass of metal in the detergent component, comprises magnesium derived from the overbased magnesium detergent.

Preferably, the lubricating oil composition according to the present invention is a crankcase lubricant.

Preferably, the lubricating oil composition has a sulphated ash content of less than 0.55, more preferably less than or equal to 0.50, mass % as determined by ASTM D874.

Preferably, the mass to mass ratio, in the lubricating oil composition, of the mass of ashless aromatic amine antioxidant (B) to the mass of magnesium provided by the detergent component (C) is greater than or equal to 8 to 1, preferably greater than or equal to 10 to 1, more preferably greater than or equal to 10.5 to 1, even more preferably greater than or equal to 11 to 1. Preferably, the mass to mass ratio, in the lubricating oil composition, of the mass of ashless aromatic amine antioxidant to the mass of magnesium provided by the detergent component (C) is less than or equal to 40 to 1, more preferably less than or equal to 35 to 1, even more preferably less than or equal to 33 to 1.

Suitably, the antioxidant component (B) is an ashless (i.e. metal free) antioxidant component.

Suitably, the detergent component (C) is a metal containing (i.e. ash forming) detergent component.

According to a second aspect, the present invention provides a method of lubricating a spark-ignited or compression-ignited internal combustion engine comprising operating the engine with a lubricating oil composition as defined in accordance with the first aspect of the present invention.

According to a third aspect, the present invention provides the use, in the lubrication of a spark-ignited or compression-ignited internal combustion engine, of an antioxidant component (B), as defined in accordance with the first aspect of the present invention, comprising an oil-soluble or oil-dispersible ashless aromatic amine antioxidant, as an additive in a minor amount, in combination with a detergent component (C), as defined in accordance with the first aspect of the present invention, comprising an oil-soluble or oil-dispersible overbased magnesium detergent, as an additive in a minor amount, in a lubricating oil composition comprising an oil of lubricating viscosity in a major amount, to reduce and/or inhibit the thermal oxidation of the lubricating oil composition during operation of the engine, wherein the ashless aromatic amine antioxidant is present in an amount of at least 0.75 mass %, based on the total mass of the lubricating oil composition, and the overbased magnesium detergent provides the lubricating oil composition with at least 0.05 mass % of magnesium, based on the total mass of the lubricating oil composition, and greater than 45 mass % of the metal content of the detergent component (C), based on the total mass of metal in the detergent component, comprises magnesium derived from the overbased magnesium detergent.

Preferably, in the use according to the third aspect, the lubricating oil composition passes the Catalyst Oxidation Test (TOC-3) Procedure D55 3099 by Renault (i.e. the thermal oxidation of the lubricating oil composition is measured in accordance with and passes the Catalyst Oxidation Test (TOC-3) Procedure D55 3099 by Renault).

Preferably, in the use according to the third aspect, the lubricating oil composition has a sulphated ash content of less than 0.6 mass % as determined by ASTM D874.

Preferably, the use according to the third aspect provides a reduction and/or inhibition of the thermal oxidation induced viscosity increase of the lubricating oil composition, during operation of the engine.

According to a fourth aspect, the present invention provides a method of reducing and/or inhibiting the thermal oxidation of a lubricating oil composition in the lubrication of a spark-ignited or compression-ignited internal combustion engine, the method comprising: adding an antioxidant component (B), as defined in accordance with the first aspect of the present invention, comprising an oil-soluble or oil-dispersible ashless aromatic amine antioxidant, as an additive in a minor amount, in combination with a detergent component (C), as defined in accordance with the first aspect of the present invention, comprising an oil-soluble or oil-dispersible overbased magnesium detergent, as an additive in a minor amount, to a lubricating oil composition comprising an oil of lubricating viscosity in a major amount, wherein the ashless aromatic amine antioxidant is present in an amount of at least 0.75 mass %, based on the total mass of the lubricating oil composition, and the overbased magnesium detergent provides the lubricating oil composition with at least 0.05 mass % of magnesium, based on the total mass of the lubricating oil composition, and greater than 45 mass % of the metal content of the detergent component (C), based on the total mass of metal in the detergent component, comprises magnesium derived from the overbased magnesium detergent; and, lubricating, preferably operating, the engine with the lubricating oil composition.

Preferably, in the method according to the fourth aspect, the lubricating oil composition passes the Catalyst Oxidation Test (TOC-3) Procedure D55 3099 by Renault.

Preferably, in the method according to the fourth aspect, the lubricating oil composition has a sulphated ash content of less than 0.6 mass % as determined by ASTM D874.

Preferably, the method according to the fourth aspect provides a reduction and/or inhibition of the thermal oxidation induced viscosity increase of the lubricating oil composition, during operation of the engine.

According to a fifth aspect, the present invention provides the use of a lubricating oil composition according to a first aspect of the invention to pass the Catalyst Oxidation Test (TOC-3) Procedure D55 3099 by Renault.

According to a sixth aspect, the present invention provides a method of reducing and/or inhibiting oxidation of a lubricating oil composition, the method comprising lubricating an engine with a lubricating oil composition as defined in accordance with the first aspect of the present invention and operating the engine.

According to a seventh aspect, the present invention provides a method of reducing and/or inhibiting thermal oxidation induced viscosity increase of a lubricating oil composition, the method comprising lubricating an engine with a lubricating oil composition as defined in accordance with the first aspect of the present invention and operating the engine.

According to an eighth aspect, the present invention provides a spark-ignited or compression ignited internal combustion engine comprising a crankcase containing a lubricating oil composition as defined in accordance with the first aspect of the present invention.

In this specification, the following words and expressions, if and when used, have the meanings given below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;

"hydrocarbyl" means a chemical group of a compound that contains hydrogen and carbon atoms and that is bonded to the remainder of the compound directly via a carbon atom. The group may contain one or more atoms other than carbon and hydrogen provided they do not affect the essentially hydrocarbyl nature of the group. Those skilled in the art will be aware of suitable groups (e.g., halo, especially chloro and fluoro, amino, alkoxyl, mercapto, alkylmercapto, nitro, nitroso, sulfoxy, etc.). Preferably, the group consists essentially of hydrogen and carbon atoms, unless specified otherwise. Preferably, the hydrocarbyl group comprises an aliphatic hydrocarbyl group. The term "hydrocarbyl" includes "alkyl", "alkenyl" and "allyl" as defined herein;

"alkyl" means a $C_1$ to $C_{30}$, preferably a $C_1$ to $C_{12}$, group which is bonded to the remainder of the compound directly via a single carbon atom. Unless otherwise specified, alkyl groups may, when there are a sufficient number of carbon atoms, be linear or branched, be cyclic, acyclic or part cyclic/acyclic. Preferably, the alkyl group comprises an acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neopentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl. When specified, the alkyl group may be substituted or terminated by one or more substituents as defined herein, and/or be interrupted by one or more oxygen atoms and/or amino groups;

"alkenyl" means a $C_2$ to $C_{30}$, preferably a $C_2$ to $C_{12}$, group which includes at least one carbon to carbon double bond and is bonded to the remainder of the compound directly via a single carbon atom, and is otherwise defined as "alkyl";

"allyl" means a $C_2$ to $C_{30}$, preferably a $C_2$ to $C_{12}$, group which includes at least one carbon to carbon triple bond and is bonded to the remainder of the compound directly via a single carbon atom, and is otherwise defined as "alkyl";

"aryl" means a $C_6$ to $C_{18}$/preferably $C_6$ to $C_{10}$, aromatic group, optionally substituted by one or more alkyl groups, halo, hydroxyl, alkoxy and amino groups, which is bonded to the remainder of the compound directly via a single carbon atom. Preferred aryl groups include phenyl and naphthyl groups and substituted derivatives thereof, especially phenyl and substituted derivatives thereof;

"halo" or "halogen" includes fluoro, chloro, bromo and iodo;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"major amount" means in excess of 50 mass % of a composition;

"minor amount" means less than 50 mass % of a composition, expressed in respect of the stated additive and in respect of the total mass of all the additives present in the composition, reckoned as active ingredient of the additive or additives;

"effective minor amount" in respect of an additive means an amount of such an additive in a lubricating oil composition so that the additive provides the desired technical effect;

"ppm" means parts per million by mass, based on the total mass of the lubricating oil composition;

"metal content" of the lubricating oil composition or the detergent component, for example magnesium content, calcium content or total metal content (i.e. the sum of all individual metal contents), is measured by ASTM D5185-09;

"TBN" means total base number as measured by ASTM D2896;

"phosphorus content" is measured by ASTM D5185;

"sulfur content" is measured by ASTM D2622; and,

"sulfated ash content" is measured by ASTM D874.

All percentages reported are mass % on an active ingredient basis, i.e. without regard to carrier or diluent oil, unless otherwise stated.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to each and all aspects of the invention, will now be described in more detail as follows:

Oil of Lubricating Viscosity (A)

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural (vegetable, animal or mineral) and synthetic lubricating oils and mixtures thereof.

The oil of lubricating viscosity comprises a Group III base stock. The base stock groups are defined in the American Petroleum Institute (API) publication "Engine Oil Licensing and Certification System", Industry Services Department, Fourteenth Edition, December 1996, Addendum 1, December 1998. Typically, the base stock will have a viscosity preferably of 3-12, more preferably 4-10, most preferably 4.5-8, $mm^2/s$ (cSt) at 100° C.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Preferably, the oil of lubricating viscosity comprises greater than or equal to 10 mass %, more preferably greater than or equal to 20 mass %, even more preferably greater than or equal to 25 mass %, even more preferably greater than or equal to 30 mass %, even more preferably greater than or equal to 40 mass %, even more preferably greater than or equal to 45 mass % of a Group III base stock, based on the total mass of the oil of lubricating viscosity. Even more preferably, the oil of lubricating viscosity comprises greater than 50 mass %, preferably greater than or equal to 60 mass %, more preferably greater than or equal to 70 mass %, even more preferably greater than or equal to 80 mass %, even more preferably greater than or equal to 90 mass % of a Group III base stock, based on the total mass of the oil of lubricating viscosity. Most preferably, the oil of lubricating viscosity consists essentially of a Group III base stock. In some embodiments the oil of lubricating viscosity consists solely of Group III base stock. In the latter case it is acknowledged that additives included in the lubricating oil composition may comprise a carrier oil which is not a Group III base stock.

Other oils of lubricating viscosity which may be included in the lubricating oil composition are detailed as follows:

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

The oil of lubricating viscosity may also comprise a Group I, Group II, Group IV or Group V base stocks or base oil blends of the aforementioned base stocks.

Preferably, the volatility of the oil of lubricating viscosity or oil blend, as measured by the NOACK test (ASTM D5880), is less than or equal to 16%, preferably less than or equal to 13.5%, preferably less than or equal to 12%, more preferably less than or equal to 10%, most preferably less than or equal to 8%. Preferably, the viscosity index (VI) of the oil of lubricating viscosity is at least 95, preferably at least 110, more preferably at least 120, even more preferably at least 125, most preferably from about 130 to 140.

The oil of lubricating viscosity is provided in a major amount, in combination with a minor amount of additive components (B) and (C), as defined herein and, if necessary, one or more co-additives, such as described hereinafter, constituting a lubricating oil composition. This preparation may be accomplished by adding the additives directly to the oil or by adding them in the form of a concentrate thereof to disperse or dissolve the additive. Additives may be added to the oil by any method known to those skilled in the art, either before, at the same time as, or after addition of other additives.

Preferably, the oil of lubricating viscosity is present in an amount of greater than 55 mass %, more preferably greater than 60 mass %, even more preferably greater than 65 mass %, based on the total mass of the lubricating oil composition. Preferably, the oil of lubricating viscosity is present in an amount of less than 98 mass %, more preferably less than 95 mass %, even more preferably less than 90 mass %, based on the total mass of the lubricating oil composition.

The lubricating oil compositions of the invention comprise defined components that may or may not remain the same chemically before and after mixing with an oleaginous carrier. This invention encompasses compositions which comprise the defined components before mixing, or after mixing, or both before and after mixing.

When concentrates are used to make the lubricating oil compositions, they may for example be diluted with 3 to 100, e.g. 5 to 40, parts by mass of oil of lubricating viscosity per part by mass of the concentrate.

Preferably, the lubricating oil composition of the present invention contains low levels of phosphorus. Suitably, the lubricating oil composition contains phosphorus in an amount of less than or equal to 0.12 mass %, preferably up to 0.11 mass %, more preferably less than or equal to 0.10 mass %, even more preferably less than or equal to 0.09 mass %, even more preferably less than or equal to 0.08 mass %, even more preferably less than or equal to 0.06 mass %, most preferably less than or equal to 0.05 mass %, of phosphorus, expressed as atoms of phosphorus, based on the total mass of the composition.

Typically, the lubricating oil composition may contain low levels of sulfur. Preferably, the lubricating oil composition contains sulphur in an amount of up to 0.4, more preferably up to 0.3, most preferably up to 0.2, mass % sulfur, expressed as atoms of sulfur, based on the total mass of the composition.

Suitably, the lubricating oil composition may have a total base number (TBN) of 4 to 15, preferably 5 to 12. In heavy duty diesel (HDD) engine applications the TBN of the lubricating composition ranges from about 4 to 12, such as 6 to 12. In a passenger car diesel engine lubricating oil composition (PCDO) and a passenger car motor oil for a spark-ignited engine (PCMO), the TBN of the lubricating composition ranges from about 5.0 to about 12.0, such as from about 5.0 to about 11.0. Preferably, the lubricating oil composition is a multigrade oil identified by the viscometric descriptor SAE 20WX, SAE 15WX, SAE 10WX, SAE 5WX or SAE 0WX, where X represents any one of 20, 30, 40 and 50; the characteristics of the different viscometric grades can be found in the SAE J300 classification. In an embodiment of each aspect of the invention, independently of the other embodiments, the lubricating oil composition is in the form of an SAE 10WX, SAE 5WX or SAE 0WX, preferably in the form of an SAE 5WX or SAE 0WX, wherein X represents any one of 20, 30, 40 and 50. Preferably X is 20 or 30.

Antioxidant Component (B)

Suitably, the antioxidant component (B) is (i.e. consists of) an ashless antioxidant component and all references herein to the antioxidant component (B) apply equally to the ashless antioxidant component and vice versa.

Antioxidant component B comprises an oil-soluble or oil-dispersible ashless (i.e. metal free) aromatic amine antioxidant.

The ashless aromatic amine antioxidant is present in an amount of at least 0.75 mass % of the lubricating oil composition, based on the total mass of the lubricating oil composition. Preferably, the ashless aromatic amine antioxidant is present in an amount of at least 0.8, even more preferably at least 0.9, most preferably at least 1.0, mass % of the lubricating oil composition, based on the total mass of the lubricating oil composition. Preferably, the ashless aromatic amine antioxidant is present in an amount of less than or equal to 2.5, more preferably less than or equal to 2.4, even more preferably less than or equal to 2.3, even more preferably less than or equal to 2.2, even more preferably less than or equal to 2.1, even more preferably less than or equal to 2.0, most preferably less than or equal to 1.5, mass % of the lubricating oil composition, based on the total mass of the lubricating oil composition.

Suitable ashless aromatic amine antioxidants include aromatic substituted triazoles, phenothiazines, diaryl amines, aryl-α-naphthylamines, aryl-β-naphthylamines, aryl diamines, and substituted derivatives thereof.

Preferably, the ashless aromatic amine antioxidant comprises an aryl amine, namely an aromatic amine which includes one or more aryl groups attached directly to one or more amino groups via one or more carbon to nitrogen single bonds. Preferred aryl amines include: diaryl amines comprising compounds including two aryl groups each of which are independently attached directly to a common (i.e. single) amino group via a carbon to nitrogen single bond; aryl polyamines, such as aryl diamines, comprising compounds including a single aryl group which is bonded directly to at least two or more separate amino groups by two or more separate carbon to nitrogen single bonds; and, combinations thereof. Most preferred aryl amines comprise diaryl amines. Preferred aryl groups include phenyl and naphthyl and substituted derivatives thereof, especially phenyl groups and substituted derivatives thereof (e.g. alkyl substituted phenyl groups).

A most preferred ashless aromatic amine antioxidant comprises a diaryl amine antioxidant, especially a diphenyl amine antioxidant and substituted (e.g. alkyl substituted) derivatives thereof, more especially di(alkylphenyl)amines.

Preferred diaryl amines comprise diphenyl amines and substituted derivatives thereof (e.g. di(alkylphenyl)amines), especially diphenyl amines of the general formula (I)

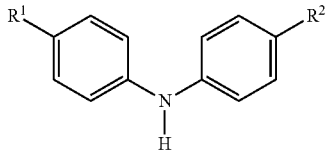

(I)

wherein, $R^1$ and $R^2$ are the same or different and each independently represent hydrogen, $C_1$ to $C_{12}$ alkyl, $C_2$ to $C_{12}$ alkenyl, $C_2$ to $C_{12}$ alkyl, and wherein the diphenyl amine is in the form of a free base or an oil-soluble salt. Preferably, $R^1$ represents $C_1$ to $C_{12}$ alkyl, more preferably $C_4$ to $C_{12}$ alkyl, even more preferably $C_4$ to $C_9$ alkyl, especially $C_8$ to $C_9$ alkyl. Preferably, $R^2$ represents hydrogen or $C_1$ to $C_{12}$ alkyl, more preferably $C_4$ to $C_{12}$ alkyl, even more preferably $C_4$ to $C_9$ alkyl, especially $C_8$ to $C_9$ alkyl. Most preferably, $R^1$ and $R^2$ are identical in a compound of Formula (I). One such highly preferred compound is Naugalube 438L available from Chemtura comprising 4,4'-dinonyldiphenylamine (i.e. bis(4-nonylphenyl)amine) wherein the nonyl groups are branched. Another highly preferred commercially available compound is Irganox L-57 available from Ciba which is believed to be an alkylated diphenyl amine containing both butyl and iso-octyl groups.

Preferred aryl polyamines comprise aryl diamines and substituted (e.g. alkyl substituted) derivatives thereof (e.g. N,N' dialkyl aryl diamines), especially phenylene diamines and alkyl substituted derivatives thereof (e.g. N,N' dialkyl phenylene diamines). Highly preferred phenylene diamines and substituted derivatives thereof may be represented by compounds of the general formula (II)

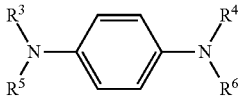

(II)

wherein $R^3$ and $R^4$ are the same or different and each independently represents an alkyl, alkenyl, allyl or methallyl group of up to 30 carbon atoms, a cycloalkyl or cycloalkenyl group of 5 to 7 carbon atoms optionally substituted by one or more alkyl, alkenyl, allyl or methallyl groups of up to 30 carbon atoms each, an aryl group, an aryl group substituted by one or more alkyl, alkenyl, allyl or methallyl groups of up to 30 carbon atoms each, or an aryl-alkyl, aryl-alkenyl, aryl-allyl or aryl-methallyl group with up to 30 carbon atoms in the alkyl, alkenyl, allyl or methallyl residue and optionally substituted on the aryl moiety by one or more alkyl, alkenyl, allyl or methallyl groups of up to 30 carbon atoms each; and $R^5$ and $R^6$ are the same of different and each independently represents H, an alkyl, alkenyl, allyl or methallyl group of up to 30 carbon atoms, a cycloalkyl or cycloalkenyl group of 5 to 7 carbon atoms optionally substituted by one or more alkyl, alkenyl, allyl or methallyl groups of up to 30 carbon atoms each, an aryl group, an aryl group substituted by one or more alkyl, alkenyl, allyl or methallyl groups of up to 30 carbon atoms each, or an aryl-alkyl, aryl-alkenyl, aryl-allyl or aryl-methallyl group with up to 30 carbon atoms in the alkyl, alkenyl, allyl or methallyl residue and optionally substituted on the aryl moiety by one or more alkyl, alkenyl, allyl or methallyl groups of up to 30 carbon atoms each; and, wherein said phenylene diamine is in the form of a free base, or an oil-soluble salt.

Preferably, $R^3$ and $R^4$ are the same or different and each independently represents an alkyl, alkenyl, allyl or methallyl group of up to 16 carbon atoms, a cycloalkyl or cycloalkenyl group of 5 to 7 carbon atoms optionally substituted by one or more alkyl, alkenyl, allyl or methallyl groups of up to 16 carbon atoms each, an aryl radical, an aryl group substituted by one or more alkyl, alkenyl, allyl or methallyl groups of up to 16 carbon atoms each, or an aryl-alkyl, aryl-alkenyl, aryl-allyl or aryl-methallyl group with up to 16 carbon atoms in the alkyl, alkenyl, allyl or methallyl residue and optionally substituted on the aryl moiety by one or more alkyl, alkenyl, allyl or methallyl radicals of up to 16 carbon atoms each.

More preferably, $R^3$ and $R^4$ are the same or different and each independently represents a $C_3$ to $C_{12}$, especially $C_4$ to $C_{10}$, alkyl group.

Highly preferred compounds of Formula (II) are wherein $R^3$ and $R^4$ are identical.

Preferably, $R^5$ and $R^6$ are the same or different and each independently represents hydrogen, an alkyl, alkenyl, allyl or methallyl group of up to 16 carbon atoms, a cycloalkyl or cycloalkenyl group of 5 to 7 carbon atoms optionally substituted by one or more alkyl, alkenyl, allyl or methallyl groups of up to 16 carbon atoms each, an aryl radical, an aryl group substituted by one or more alkyl, alkenyl, allyl or methallyl groups of up to 16 carbon atoms each, or an aryl-alkyl, aryl-alkenyl, aryl-allyl or aryl-methallyl group with up to 16 carbon atoms in the alkyl, alkenyl, allyl or methallyl residue and optionally substituted on the aryl moiety by one or more alkyl, alkenyl, allyl or methallyl radicals of up to 16 carbon atoms each.

More preferably, $R^5$ and $R^6$ are the same or different and each independently represents hydrogen, a $C_3$ to $C_{12}$, especially $C_4$ to $C_{10}$, alkyl group.

Highly preferred compounds of Formula (II) are wherein $R^5$ and $R^6$ are identical.

Especially preferred compounds of formula (II) include those wherein each of $R^5$ and $R^6$ is hydrogen and $R^3$ and $R^4$ are the same or different, preferably the same, and each independently represents a $C_3$ to $C_{12}$, especially $C_4$ to $C_{10}$, alkyl group. Alternative especially preferred compounds of formula (II) include those wherein $R^5$ and $R^6$ are identical and each represents a $C_3$ to $C_{12}$, especially $C_4$ to $C_{10}$, alkyl group and $R^3$ and $R^4$ are the same or different, preferably the same, and each independently represents a $C_3$ to $C_{12}$, especially $C_4$ to $C_{10}$, alkyl group.

Suitable phenylene diamine compounds include Naugalube 410 and 420 available from Chemtura.

Preferably, the ashless aromatic amine antioxidant compound has, or have on average, a nitrogen content of from about 3 mass % to about 13 mass %, preferably from about 4.5 mass % to about 10.5 mass %, more preferably from about 7 mass % to about 10 mass %.

Although antioxidant component (B) may include one or more ashless non-aminic antioxidants as defined herein supra, it has been found that such antioxidants, particularly phenolic type antioxidants, do not appear to have either a beneficial or detrimental effect in terms of thermal oxidation stability of the lubricating oil composition (i.e. such antioxidants are essentially neutral in terms of thermal oxidation induced viscosity increase). Preferably, the lubricating oil composition includes less than 0.5, more preferably less than 0.3, even more preferably less than 0.2, mass %, based on the total mass of the lubricating oil composition, of one or more phenolic type antioxidants. Thus, according to a preferred embodiment of the present invention the lubricating oil composition does not include any phenolic type antioxidants. According to an even more preferred embodiment of the present invention the antioxidant component (B), especially the ashless antioxidant component, consists essentially of one or more ashless aromatic amine antioxidants as defined herein.

Detergent Component (C)

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps", that is metal salts of acidic organic compounds.

Detergents generally comprise a polar head with a long hydrophobic tail, the polar head comprising a metal salt of an acidic organic compound. The salts may contain a substantially stoichiometric amount of the metal when they are usually described as normal or neutral salts and would typically have a total base number or TBN (as may be measured by ASTM D2896) of from 0 to 80. Large amounts of a metal base can be included by reaction of an excess of a metal compound, such as an oxide or hydroxide, with an acidic gas such as carbon dioxide. The resulting overbased detergent comprises neutralised detergent as an outer layer of a metal base (e.g. carbonate) micelle. Such overbased detergents may have a TBN of 150 or greater, and typically of from 250 to 500 or more.

Suitably, the detergent component (C) is (i.e. consists of) a metal containing detergent component and all references herein to the detergent component (C) apply equally to the metal containing detergent component and vice versa.

The detergent component (C) comprises an oil-soluble or oil-dispersible overbased magnesium detergent providing the lubricating oil composition with at least 0.05 mass % of magnesium measured in accordance with ASTM D5185-09, based on the total mass of the lubricating oil the composition, wherein the overbased magnesium detergent provides the detergent component with greater than 45 mass % of magnesium, based on the total mass of metal in the detergent component i.e. greater than 45 mass % of the total metal content of the detergent component (C) is magnesium which is derived from the overbased magnesium detergent.

Preferably, the overbased magnesium detergent has a total base number (TBN) of at least 150, more preferably at least 250, even more preferably at least 300, most preferably at least 320, mg/g KOH as determined by ASTM D2896. The TBN of the overbased magnesium detergent may be in excess of 350 mg/g KOH.

Unexpectedly, it has been found that by increasing the relative amount of magnesium, in comparison to other metals, in the detergent component (C) for a low sulphated ash lubricating oil composition of the present invention having a fixed amount of antioxidant component (B), whilst maintaining a constant sulphated ash level for the lubricant, typically improves the thermal oxidation stability of the lubricant, thereby reducing the thermal oxidation induced viscosity increase of the lubricant in use.

Thus, preferably greater than or equal to 50, more preferably greater than or equal to 55, even more preferably greater than or equal to 60, even more preferably greater than or equal to 70, even more preferably greater than or equal to 75, even more preferably greater than or equal to 80, even more preferably greater than or equal to 85, even more preferably greater than or equal to 90, most preferably greater than or equal to 95, mass % of the total metal content of the detergent component (C), especially the metal containing detergent component, comprises magnesium which is derived from the overbased magnesium detergent.

Thus, in accordance with a preferred embodiment of the present invention the detergent component (C) (i.e. the metal containing detergent component) consists essentially of the overbased magnesium detergent, preferably it consists solely of the overbased magnesium detergent.

Suitably, the overbased magnesium detergent of the detergent component (C) contributes greater than 45, preferably greater than or equal to 50, more preferably greater than or equal to 60, even more preferably greater than or equal to 70, even more preferably greater than or equal to 75, even more preferably greater than or equal to 80, even more preferably greater than or equal to 85, even more preferably greater than or equal to 90, most preferably greater than or equal to 95, % of the TBN of the detergent component, based on the total TBN of the detergent component.

Preferably, the overbased magnesium detergent provides the lubricating oil composition with greater than or equal to 0.06, more preferably greater than or equal to 0.07, mass % of magnesium, based on the total mass of the lubricating oil composition. Preferably, the overbased magnesium detergent provides the lubricating oil composition with less than or equal to 0.15, even more preferably less than or equal to 0.14, even more preferably less than or equal to 0.13, even more preferably less than or equal to 0.12, even more preferably less than or equal to 0.11, mass % of magnesium, based on the total mass of the lubricating oil composition.

Suitably, it will be appreciated that the detergent component (C) is included in the lubricating oil composition in an amount such that total amount of sulphated ash contributed by the detergent component to the lubricant, and any other metal containing component which may be present, is less than 0.60, preferably at most 0.55, more preferably at most 0.50, mass %. Preferably, the detergent component (C) is present in an amount of 0.1 to 15, more preferably 0.2 to 9, mass %, based on the total mass of the lubricating oil composition Additionally, it has also been found that by increasing the mass to mass ratio, in the lubricating oil composition, of the mass of ashless aromatic amine antioxidant to the mass of magnesium contributed by the overbased magnesium detergent for a lubricating oil composition having a fixed sulphated ash content typically further improves the thermally induced oxidative stability of the lubricant. Thus preferably, the mass to mass ratio, in the lubricating oil composition, of the mass of ashless aromatic amine antioxidant (B) to the mass of magnesium provided by the detergent component (C) is greater than or equal to 8 to 1, preferably greater than or equal to 10 to 1, more preferably greater than or equal to 10.5 to 1, even more preferably greater than or equal to 11 to 1. Preferably, the mass to mass ratio, in the lubricating oil composition, of the mass of ashless aromatic amine antioxidant to the mass of magnesium provided by the detergent component (C) is less than or equal to 40 to 1, more preferably less than or equal to 35 to 1, even more preferably less than or equal to 33 to 1.

Suitable overbased magnesium detergents which may be used include oil-soluble and oil-dispersible overbased (i.e. having a TBN of at least 150 mg/g KOH as determined by ASTM D2896) magnesium sulfonates, phenates, sulfurized phenates, thiophosphonates, salicylates, naphthenates and other magnesium aromatic organic carboxylates. Overbased magnesium salicylates and overbased magnesium sulphonates are particularly preferred, especially overbased magnesium salicylates. Highly preferred, overbased magnesium salicylates comprise $C_8$ to $C_{30}$ allyl, especially $C_{14}$ to $C_{18}$ alkyl, substituted salicylates wherein the alkyl group(s) may be linear, branched or cyclic. As examples of suitable alkyl groups there may be mentioned the following: octyl; nonyl;

decyl; dodecyl; pentadecyl; octadecyl; eicosyl; docosyl; tricosyl; hexacosyl; and, triacontyl.

It will be appreciated that the detergent component (C) may also include one or more other metal detergents in addition to the overbased magnesium detergent. Other suitable detergents which may be present in the lubricating oil composition, in addition to the overbased magnesium detergent, include oil-soluble or oil-dispersible neutral and overbased sulfonates, phenates, sulfurized phenates, thiophosphonates, salicylates and naphthenates and other oil-soluble aromatic organic carboxylates, of a metal, particularly an alkali or alkaline earth metal e.g. sodium, potassium or calcium. If the detergent component (C) includes one or more metal detergents in addition to the overbased magnesium detergent, then calcium based detergents are preferred, particularly oil-soluble and oil-dispersible neutral and overbased calcium sulphonates and salicylates.

Suitably, by decreasing the amount of metal atoms, other than magnesium, in the detergent component (C) for a lubricating oil composition of the present invention having a fixed antioxidant component (B) content and a fixed sulphated ash content typically enhances the thermal oxidation stability of the lubricant.

Thus, the one or more other metal detergents (i.e. calcium sulphonates and calcium salicylate), in addition to the overbased magnesium detergent, may provide the detergent component (C) with up to 55, preferably up to 40, more preferably up to 30, even more preferably up to 25, even more preferably up to 20, even more preferably up to 15, even more preferably up to 10, even more preferably up to 5, mass % of metal other than magnesium, especially calcium, based on the total mass of metal in the detergent component (C).

Preferably, the one or more other metal detergents (i.e. apart from the overbased magnesium detergent) provide the lubricating oil composition with less than 0.15, preferably less than 0.14, more preferably less than 0.12, even more preferably less than 0.10, even more preferably less than 0.08, even more preferably, less than 0.07, even more preferably less than or equal to 0.06, even more preferably less than or equal to 0.05, even more preferably less than or equal to 0.04, even more preferably less than or equal to 0.03, even more preferably less than or equal to 0.02, most preferably less than or equal to 0.01, mass % of metal other than magnesium, based on the total mass of the lubricating oil composition.

Engines

The lubricating oil compositions of the invention may be used to lubricate mechanical engine components, particularly in internal combustion engines, e.g. spark-ignited or compression-ignited internal combustion engines, particularly spark-ignited or compression-ignited two- or four-stroke reciprocating engines, by adding the composition thereto. The engines may be conventional gasoline or diesel engines designed to be powered by gasoline or petroleum diesel, respectively; alternatively, the engines may be specifically modified to be powered by an alcohol based fuel or biodiesel fuel. Most preferably, the engine comprises a compression-ignited internal combustion engine. Preferably, the lubricating oil compositions are crankcase lubricants.

Co-Additives

Co-additives, with representative effective amounts, that may also be present, different from additive component (B), are listed below. All the values listed are stated as mass percent active ingredient in a fully formulated lubricant.

| Additive | Mass % (Broad) | Mass % (Preferred) |
|---|---|---|
| Ashless Dispersant | 0.1-20 | 1-8 |
| Metal Detergents | 0.1-15 | 0.2-9 |
| Friction modifier | 0-5 | 0-1.5 |
| Corrosion Inhibitor | 0-5 | 0-1.5 |
| Metal Dihydrocarbyl Dithiophosphate | 0-10 | 0-4 |
| Anti-Oxidants | 0-5 | 0.01-3 |
| Pour Point Depressant | 0.01-5 | 0.01-1.5 |
| Anti-Foaming Agent | 0-5 | 0.001-0.15 |
| Supplement Anti-Wear Agents | 0-5 | 0-2 |
| Viscosity Modifier (1) | 0-6 | 0.01-4 |
| Mineral or Synthetic Base Oil | Balance | Balance |

(1) Viscosity modifiers are used only in multi-graded oils.

The final lubricating oil composition, typically made by blending the or each additive into the base oil, may contain from 5 to 25, preferably 5 to 18, typically 7 to 15, mass % of the co-additives, the remainder being oil of lubricating viscosity.

Preferably, the lubricating oil composition includes one or more co-additives in a minor amount, other than additive components (B) and (C), selected from ashless dispersants, metal detergents, corrosion inhibitors, antioxidants, pour point depressants, antiwear agents, friction modifiers, demulsifiers, antifoam agents and viscosity modifiers.

The above mentioned co-additives are discussed in further detail as follows; as is known in the art, some additives can provide a multiplicity of effects, for example, a single additive may act as a dispersant and as an oxidation inhibitor.

A dispersant is an additive whose primary function is to hold solid and liquid contaminations in suspension, thereby passivating them and reducing engine deposits at the same time as reducing sludge depositions. For example, a dispersant maintains in suspension oil-insoluble substances that result from oxidation during use of the lubricant, thus preventing sludge flocculation and precipitation or deposition on metal parts of the engine.

Dispersants are usually "ashless", as mentioned above, being non-metallic organic materials that form substantially no ash on combustion, in contrast to metal-containing, and hence ash-forming materials. They comprise a long hydrocarbon chain with a polar head, the polarity being derived from inclusion of e.g. an O, P, or N atom. The hydrocarbon is an oleophilic group that confers oil-solubility, having, for example 40 to 500 carbon atoms. Thus, ashless dispersants may comprise an oil-soluble polymeric backbone.

A preferred class of olefin polymers is constituted by polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. No. 3,202,678; U.S. Pat. No. 3,154,560; U.S. Pat. No. 3,172,892; U.S. Pat. No. 3,024,195; U.S. Pat. No. 3,024,237, U.S. Pat. No. 3,219,666; and U.S. Pat. No. 3,216,936, that may be post-treated to improve their properties, such as borated (as described in U.S. Pat. No. 3,087,936 and U.S. Pat. No. 3,254,025) fluorinated and oxylated. For example, boration may be accomplished by treating an acyl nitrogen-containing dispersant with a boron compound selected from boron oxide, boron halides, boron acids and esters of boron acids.

Preferably, the lubricating oil composition includes an oil-soluble boron containing compound, especially a borated dispersant. Preferably, the borated dispersant comprises an ashless nitrogen containing borated dispersant, such as a borated polyalkenyl succinimide, especially a borated polyisobutenyl succinimide.

Friction modifiers include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted monoamines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Suitable oil-soluble organo-molybdenum compounds have a molybdenum-sulfur core. As examples there may be mentioned dithiocarbamates, dithiophosphates, dithiophosphinates, xanthates, thioxanthates, sulfides, and mixtures thereof. Particularly preferred are molybdenum dithiocarbamates, dialkyldithiophosphates, alkyl xanthates and alkylthioxanthates. The molybdenum compound is dinuclear or trinuclear.

One class of preferred organo-molybdenum compounds useful in all aspects of the present invention is tri-nuclear molybdenum compounds of the formula $Mo_3S_kL_nQ_z$ and mixtures thereof wherein L are independently selected ligands having organo groups with a sufficient number of carbon atoms to render the compounds soluble or dispersible in the oil, n is from 1 to 4, k varies from 4 through to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The molybdenum compounds may be present in a lubricating oil composition at a concentration in the range 0.1 to 2 mass %, or providing at least 10 such as 50 to 2,000 ppm by mass of molybdenum atoms.

Preferably, the molybdenum from the molybdenum compound is present in an amount of from 10 to 1500, such as 20 to 1000, more preferably 30 to 750, ppm based on the total weight of the lubricating oil composition. For some applications, the molybdenum is present in an amount of greater than 500 ppm.

Anti-oxidants are sometimes referred to as oxidation inhibitors; they increase the resistance of the composition to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

Antioxidants other than the ashless aromatic amine antioxidant of antioxidant component (B) which may be included comprise radical scavengers (e.g. sterically hindered phenols and organo-copper salts); hydroperoxide decomposers (e.g., organosulfur and organophosphorus additives); and multifunctionals (e.g. zinc dihydrocarbyl dithiophosphates, which may also function as anti-wear additives, and organo-molybdenum compounds, which may also function as friction modifiers and anti-wear additives).

Anti-wear agents reduce friction and excessive wear and are usually based on compounds containing sulfur or phosphorous or both, for example that are capable of depositing polysulfide films on the surfaces involved. Noteworthy are dihydrocarbyl dithiophosphate metal salts wherein the metal may be an alkali or alkaline earth metal, or aluminium, lead, tin, molybdenum, manganese, nickel, copper, or preferably, zinc.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are mostgenerally employed. Commercial additives frequently contain an excess of metal due to the use of an excess of the basic metal compound in the neutralization reaction.

The preferred dihydrocarbyl dithiophosphate metal salts are zinc dihydrocarbyl dithiophosphates (ZDDP) which are oil-soluble salts of dihydrocarbyl dithiophosphoric acids and may be represented by the following formula:

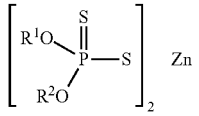

wherein $R^1$ and $R^2$ may be the same or different hydrocarbyl radicals containing from 1 to 18, preferably 2 to 12, carbon atoms and include radicals such as alkyl, alkenyl, aryl, arylalkyl, alkaryl and cycloaliphatic radicals. Particularly preferred as $R^1$ and $R^2$ groups are alkyl groups of 2 to 8 carbon atoms, especially primary alkyl groups (i.e. $R^1$ and $R^2$ are derived from predominantly primary alcohols). Thus, the radicals may, for example, be ethyl, n-propyl, i-propyl, n-butyl, iso-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. $R^1$ and $R^2$) in the dithiophosphoric acid will generally be about 5 or greater. Preferably, the zinc dihydrocarbyl dithiophosphate comprises a zinc dialkyl dithiophosphate.

Preferably, the lubricating oil composition contains an amount of dihydrocarbyl dithiophosphate metal salt that introduces 0.02 to 0.10 mass %, preferably 0.02 to 0.09 mass %, preferably 0.02 to 0.08 mass %, more preferably 0.02 to 0.06 mass % of phosphorus into the composition.

To limit the amount of phosphorus introduced into the lubricating oil composition to no more than 0.10 mass %, the dihydrocarbyl dithiophosphate metal salt should preferably be added to the lubricating oil compositions in amounts no greater than from 1.1 to 1.3 mass % (a.i.), based upon the total mass of the lubricating oil composition.

Examples of ashless anti-wear agents include 1,2,3-triazoles, benzotriazoles, sulfurised fatty acid esters, and dithiocarbamate derivatives.

Rust and corrosion inhibitors serve to protect surfaces against rust and/or corrosion. As rust inhibitors there may be mentioned non-ionic polyoxyalkylene polyols and esters thereof, polyoxyalkylene phenols, thiadiazoles and anionic alkyl sulfonic acids.

Pour point depressants, otherwise known as lube oil flow improvers, lower the minimum temperature at which the oil will flow or can be poured. Such additives are well known. Typical of these additive are $C_8$ to $C_{18}$ dialkyl fumerate/vinyl acetate copolymers and polyalkylmethacrylates.

Additives of the polysiloxane type, for example silicone oil or polydimethyl siloxane, can provide foam control.

A small amount of a demulsifying component may be used. A preferred demulsifying component is described in EP-A-330,522. It is obtained by reacting an alkylene oxide with an adduct obtained by reaction of a bis-epoxide with a polyhydric alcohol. The demulsifier should be used at a level not exceeding 0.1 mass % active ingredient. A treat rate of 0.001 to 0.05 mass % active ingredient is convenient.

Viscosity modifiers (or viscosity index improvers) impart high and low temperature operability to a lubricating oil. Viscosity modifiers that also function as dispersants are also known and may be prepared as described above for ashless dispersants. In general, these dispersant viscosity modifiers are functionalised polymers (e.g. interpolymers of ethylene-propylene post grafted with an active monomer such as maleic anhydride) which are then derivatised with, for example, an alcohol or amine.

The lubricant may be formulated with or without a conventional viscosity modifier and with or without a dispersant viscosity modifier. Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

The additives may be incorporated into an oil of lubricating viscosity (also known as a base oil) in any convenient way. Thus, each additive can be added directly to the oil by dispersing or dissolving it in the oil at the desired level of concentration. Such blending may occur at ambient temperature or at an elevated temperature. Typically an additive is available as an admixture with a base oil so that the handling thereof is easier.

When a plurality of additives are employed it may be desirable, although not essential, to prepare one or more additive packages (also known as additive compositions or concentrates) comprising additives and a diluent, which can be a base oil, whereby the additives, with the exception of viscosity modifiers, multifunctional viscosity modifiers and pour point depressants, can be added simultaneously to the base oil to form the lubricating oil composition. Dissolution of the additive package(s) into the oil of lubricating viscosity may be facilitated by diluent or solvents and by mixing accompanied with mild heating, but this is not essential. The additive package(s) will typically be formulated to contain the additive(s) in proper amounts to provide the desired concentration in the final formulation when the additive package(s) is/are combined with a predetermined amount of oil of lubricating viscosity. Thus, one or more detergents may be added to small amounts of base oil or other compatible solvents (such as a carrier oil or diluent oil) together with other desirable additives to form additive packages containing from 2.5 to 90, preferably from 5 to 75, most preferably from 8 to 60, mass %, based on the mass of the additive package, of additives on an active ingredient basis in the appropriate proportions. The final formulations may typically contain 5 to 40 mass % of the additive package(s), the remainder being oil of lubricating viscosity.

EXAMPLES

The invention will now be particularly described in the following examples which are not intended to limit the scope of the claims hereof.

Thermal Oxidation Control: the Renault Catalysis Oxidation Test (TOC-3) Procedure Thermal oxidation control of a lubricant is evaluated employing the Catalyst Oxidation Test (TOC-3) Procedure by Renault D55 3099-09. This test method assesses the resistance against oxidation of an engine lubricating oil composition and the method simulates changes in engine oils subjected to harsh conditions of increased load and regime, and hot casing.

In the TOC-3 procedure, four tubes each containing 150 g of oil containing anhydrous iron (III) acetylacetonate catalyst (360 ppm iron) are heated in a test cell at 170° C. for 168 hours. During which time air is blown through the oil in the tubes at a rate of 10 liters per hour. Samples of each oil (30 ml) are assessed for oxidative degradation after 16 hours, 96 hours, 136 hours and 168 hours; the samples after 96 hours providing the average value for the TOC-3 procedure. The oxidative degradation of an oil samples is assessed using infra-red spectrometry by measuring the area of the infra-red band between 1800 to 1650 $cm^{-1}$ (C═O) and comparing the increase in area of this band with that of the original oil (sample at t=0). A lower peak area increase indicates lower oxidative degradation and to pass the TOC-3 test a peak area increase after 96 hours must be less than 400.

TOC-3 Test Results

A series of 5W/40 multigrade lubricating oil compositions, as detailed in Table 1, were prepared by admixing a Group III base stock with known additives. Each of the lubricating oil compositions has a phosphorus concentration of 0.05 mass % as measured by ASTM D5185, a sulphur concentration of 0.1 mass % as measured by ASTM D2622 and a sulphated ash content of 0.5 mass % as measured by ASTM D874 and included identical amounts of the following additives available from Infineum UK Ltd: an ashless dispersant; a ZDDP; antifoam; a pour point depressant; and, a viscosity index improver concentrate (VI concentrate). Each of the lubricants included either an overbased calcium salicylate detergent (TBN 350), an overbased magnesium salicylate detergent (TBN 340), an overbased magnesium sulphonate detergent (TBN 400), an overbased calcium sulphonate detergent (TBN 300) or a combination thereof as detailed in Table 1. Additionally, each of the lubricants included an identical ashless aromatic amine antioxidant (bis(4-nonylphenyl)amine) in the amounts as specified in Table 1. In Table 1, Lubricants A to F represent comparative lubricants, whereas Lubricants 1 to 5 are representative of lubricating oils of the present invention.

The Lubricants were evaluated for thermal oxidation control employing the Catalysis Oxidation Procedure (TOC-3) as detailed herein, where a passing value is a Peak Area Increase of less than 400. A lower Peak Area Increase represents a stronger passing value in the test. The results are detailed in Table 1.

The results demonstrate that a lubricant having a sulphated ash content of 0.5 mass % comprising a detergent component consisting solely of an overbased calcium salicylate detergent, then in order to obtain a passing value in the TOC-3 Test it is necessary to include 2.5 mass % of the ashless aromatic amine antioxidant (Compare Lubricants A and B with Lubricant C). However, if the detergent component of Lubricant C is modified so that it includes a mixture of the overbased calcium salicylate detergent and an overbased magnesium salicylate detergent such that the detergent component provides the lubricant with 0.05 mass % of magnesium and the detergent component includes 45.5 mass % of magnesium, based on the total mass of metal in the detergent component, then a comparable passing value in the TOC-3 Test is achieved by the inclusion of only 1.0 mass % of the ashless aromatic amine antioxidant, namely a mass to mass ratio of antioxidant to magnesium of 20:1 (Compare Lubricant 1 with Lubricant C). Suitably, increasing the amount of antioxidant in Lubricant 1 from 1.0 mass % to 1.5 mass % (see Lubricant 2) provides a stronger passing value in the TOC-3 Test (Peak Area Increase for Lubricant 2 is 355 and for Lubricant 1 is 383).

TABLE 1

| | A | B | C | D | 1 | 2 | E | 3 | 4 | 5 | F |
|---|---|---|---|---|---|---|---|---|---|---|---|
| Dispersant | 7.0 | 7.0 | 7.0 | 7.0 | 7.0 | 7.0 | 7.0 | 7.0 | 7.0 | 7.0 | 7.0 |
| ZDDP | 0.5 | 0.5 | 0.5 | 0.5 | 0.5 | 0.5 | 0.5 | 0.5 | 0.5 | 0.5 | 0.5 |
| Antifoam | 0.003 | 0.003 | 0.003 | 0.003 | 0.003 | 0.003 | 0.003 | 0.003 | 0.003 | 0.003 | 0.003 |
| VI Concentrate | 6.5 | 6.5 | 6.5 | 6.5 | 6.5 | 6.5 | 6.5 | 6.5 | 6.5 | 6.5 | 6.5 |
| Pour Point | 0.3 | 0.3 | 0.3 | 0.3 | 0.3 | 0.3 | 0.3 | 0.3 | 0.3 | 0.3 | 0.3 |
| Antioxidant (AO) | 0.5 | 1.5 | 2.5 | 0.5 | 1.0 | 1.5 | 0.5 | 1.0 | 1.5 | 1.5 | 1.5 |
| Calcium Salicylate | 0.96 | 0.96 | 0.96 | 0.48 | 0.48 | 0.48 | — | — | — | — | — |
| Magnesium Salicylate | — | — | — | 0.63 | 0.63 | 0.63 | 1.27 | 1.27 | 1.27 | — | — |
| Magnesium Sulphonate | — | — | — | — | — | — | — | — | — | 1.1 | — |
| Calcium Sulphonate | — | — | — | — | — | — | — | — | — | — | 1.1 |
| Group III basestock | balance | balance | balance | balance | balance | balance | balance | balance | balance | balance | balance |
| Ca mass % | 0.12 | 0.12 | 0.12 | 0.06 | 0.06 | 0.06 | — | — | — | — | 0.12 |
| Mg mass % | — | — | — | 0.05 | 0.05 | 0.05 | 0.09 | 0.09 | 0.10 | 0.10 | — |
| Mass ratio AO:Mg | — | — | — | 10:1 | 20:1 | 30:1 | 5.5:1 | 11:1 | 15:1 | 15:1 | — |
| TOC (peak area) | 526 | 463 | 382 | 464 | 383 | 355 | 475 | 305 | 272 | 318 | 394 |
| Pass/Fail | Fail | Fail | Pass | Fail | Pass | Pass | Fail | Pass | Pass | Pass | Bare pass/fail |

The results also demonstrate that by increasing the amount of overbased magnesium salicylate detergent in the detergent component of Lubricants 1 and 2, whilst maintaining a fixed sulphated ash level, provides a stronger passing value in the TOC-3 Test. Thus, if the detergent component of Lubricant 1 is modified from a mixture of an overbased magnesium salicylate detergent and overbased calcium salicylate detergent to consisting solely of an overbased magnesium salicylate detergent as in Lubricant 3, then the Peak Area increase in the TOC-3 Test decreases from 383 to 305, thereby indicating a stronger passing value. Similarly, if the detergent component of Lubricant 2 is modified from a mixture of an overbased magnesium salicylate detergent and calcium salicylate detergent to consisting solely of an overbased magnesium salicylate detergent as in Lubricant 4, then the Peak Area increase in the TOC-3 Test decreases from 355 to 272, thereby indicating a stronger passing value.

Additionally, the results also demonstrate that a lubricant having a detergent component comprising an overbased magnesium salicylate detergent provides a similar passing value in the TOC-3 Test as a comparable lubricant having a detergent component comprising an overbased magnesium sulphonate detergent (compare Lubricant 4 with Lubricant 5 in Table 1). Notably, a comparative Lubricant including an overbased calcium sulphonate detergent (Comparative Lubricant F) only provides a bare pass/fail in the TOC-3 Test.

What is claimed is:

1. A lubricating oil composition having a sulphated ash content of less than 0.6 mass % as determined by ASTM D874, the composition comprising:

(A) an oil of lubricating viscosity in a major amount;

(B) an antioxidant component, as an additive in a minor amount, comprising one or more oil-soluble or oil-dispersible ashless aromatic amine antioxidants selected from the group consisting of diaryl amine and aryl diamine antioxidants, present in an amount of 0.75 mass % to 2.0 mass %, based on the total mass of the lubricating oil composition; and, (C) a detergent component, as an additive comprising oil-soluble or oil-dispersible overbased magnesium sulfonate detergent, oil-soluble or oil-dispersible overbased magnesium salicylate detergent, or combination of oil-soluble or oil-dispersible overbased magnesium sulfonate detergent and oil-soluble or oil-dispersible overbased magnesium salicylate detergent, having a TBN of at least 300 mg KOH/g as determined by ASTM D2896, in an amount providing the lubricating oil composition with at least 0.05 mass % of magnesium, based on the total mass of the lubricating oil composition, wherein greater than 45 mass % of the metal content of the detergent component (C), based on the total mass of metal in the detergent component, comprises magnesium derived from the overbased magnesium detergent; and wherein the mass to mass ratio, in the lubricating oil composition, of the mass of ashless aromatic amine antioxidant (B) to the mass of magnesium provided by the detergent component (C) is greater than or equal to 11:1.

2. A lubricating oil composition as claimed in claim 1, wherein the sulphated ash content is less than 0.55 mass % as determined by ASTM D874.

3. A lubricating oil composition as claimed in claim 1, wherein the ashless aromatic amine antioxidant is present in an amount of at least 0.8 mass %, based on the total mass of the lubricating oil composition.

4. A lubricating oil composition as claimed in claim 1, wherein the overbased magnesium detergent is selected from one or more magnesium sulphonates, magnesium salicylates and magnesium phenates, preferably one or more magnesium salicylates.

5. A lubricating oil composition as claimed in claim 4, wherein the overbased magnesium detergent is one or more magnesium salicylate.

6. A lubricating oil composition as claimed in claim 1, wherein greater than or equal to 50 mass % of the total metal content of the detergent component (C) comprises magnesium derived from the overbased magnesium detergent.

7. A lubricating oil composition as claimed in claim 1, wherein the overbased magnesium detergent provides the composition with at least 0.06 mass % of magnesium, based on the total mass of the composition.

8. A lubricating oil composition as claimed in claim 1, further comprising one or more co-additives in a minor amount, other than additive components (B) and (C), selected from ashless dispersants, metal detergents, corrosion inhibitors, antioxidants, pour point depressants, antiwear agents, friction modifiers, demulsifiers, antifoam agents and viscosity modifiers.

9. A lubricating oil composition as claimed in claim 1, wherein the detergent component (C) consists essentially of one or more metal containing detergent components.

10. A lubricating oil composition as claimed in claim 9, wherein the metal containing detergent component consists essentially of said one or more overbased magnesium detergents.

11. A method of lubricating a spark-ignited or compression-ignited internal combustion engine comprising operating the engine with a lubricating oil composition as claimed in claim 1.

* * * * *